United States Patent [19]

Hamai et al.

[11] 4,029,475

[45] June 14, 1977

[54] BLANK FOR ROLLING AND FORGING AND METHOD OF PRODUCING SAME

[75] Inventors: Yoshihiko Hamai, Kawasaki; Tatsuro Hamai, Tokyo; Yuya Tanaka, Machida; Akira Nakatani, Niiza, all of Japan

[73] Assignee: Kabushiki Kaisha Hamai Seisakusho, Tokyo, Japan

[22] Filed: Dec. 12, 1974

[21] Appl. No.: 532,247

[30] Foreign Application Priority Data

Dec. 31, 1973 Japan ..... 49-000822
June 8, 1974 Japan ..... 49-065410

[52] U.S. Cl. ..... 75/247; 75/201; 75/228; 75/211; 427/216

[51] Int. Cl.[2] ..... B22F 3/00; C22C 1/04

[58] Field of Search ..... 29/182, 182.1, 182.5; 75/212, 201, 211; 427/216

[56] References Cited

UNITED STATES PATENTS

| | | | |
|---|---|---|---|
| 2,610,118 | 9/1952 | Drapeau | 75/212 |
| 2,846,339 | 8/1958 | Dempsey | 427/216 |
| 3,082,084 | 3/1963 | Alexander | 75/212 |
| 3,223,523 | 12/1965 | Adler | 75/212 |
| 3,386,814 | 6/1968 | Alexander | 75/212 |
| 3,401,033 | 9/1968 | Bartz | 75/211 |

FOREIGN PATENTS OR APPLICATIONS

| | | |
|---|---|---|
| 1,013,932 | 12/1965 | United Kingdom |

*Primary Examiner*—Samuel W. Engle
*Assistant Examiner*—Donald P. Walsh
*Attorney, Agent, or Firm*—Brisebois & Kruger

[57] ABSTRACT

Sintered blanks for rolling and forging, metal powders used in making such blanks, and a method of producing such blanks and powders characterized in that a compound of an alkali metal or an alkaline earth metal is added to the metal powders before sintering.

9 Claims, 7 Drawing Figures

BLANK FOR ROLLING AND FORGING AND METHOD OF PRODUCING SAME

BACKGROUND OF THE INVENTION

In the art of powder metallurgy, there is a widely known process in which a metal or alloy powder is first compacted and then the green compact is heated at a relatively low temperature in a reducing or neutral gaseous atmosphere so as to obtain a sintered compact. According to this method, it is possible to obtain a sintered compact of a material which is usually hard to melt. Furthermore, the inclusion of impurities is minimized as compared with products obtained by more usual melting methods, and hence it is possible to obtain a product having excellent physical and other properties which cannot be expected from the ordinary products formed from molten metal.

This method, however, had the problem that, the sintered compact obtained by sintering a green powder compact is porous and also, in the case of metal having high vapor pressure such as zinc, the component elements would volatilize away under the sintering heat, so that it would sometimes prove impossible to obtain a sintered blank of a desired composition. There are also materials that cannot be sintered by using this method. Thus, there has been a certain limitation as to the scope of products obtainable and the scope of use of these products. Such deficiencies have been particularly noticeable in the case of the sintering of high brass.

Therefore, the method generally employed for obtaining high-density metal-made machine parts was one of cutting solid materials or casting molten materials to the approximate size of the object product and then machining them into the desired shape. According to this conventional method, as adapted for instance to the forming of pressure-proof brass pipe parts as commonly used in industry, first the brass cutting scraps and molten material are fed into a melting furnace, followed by the addition thereto of zinc, lead and electrolytic copper to prepare a molten bath of the desired brass composition for forging. This molten bath is then shaped into an ingot, the latter being then rolled into a elongated brass bar of a desired size, and this bar is cut into a desired size to form billets. Then the cut billets are heated to around 700° C, subjected to hot forging in a mold of a predetermined configuration and further passed through the steps of trimming, surface cleaning and machining to produce a desired pressure-proof pipe part.

According to such a conventional method, since the shapes of the billets which can be forged are limited, many sections are left that require machining after forging, resulting in increased working time and loss of material. Also, when the cutting scraps formed in the working are reduced in the melting furnace, when high brass is being manufactured, it is necessary to replenish the zinc component as zinc may evaporate during the process. This increases the cost of the heat source. In many of the currently used methods, the loss in weight of the material suffered during the machining of the forged blanks exceeds 50% in the case of pipe parts, as such parts are mostly hollow in shape.

In order to overcome these disadvantages, some forging machines have been developed which are specifically designed for the forging of hollow parts, but such machines have complicated die mechanisms, and are also expensive. Consequently, they have not yet found general acceptance.

SUMMARY OF THE INVENTION

An object of the present invention is to solve the various problems encountered in the manufacture of machine parts from the molten materials formed by conventional melting methods, by utilizing a powder metallurgy process. In other words, the invention is intended to provide blanks from which desired object articles can be made economically and with ease, and a method of producing such blanks.

Another object of the invention is to provide a sintered compact which is dense in structure and capable of being easily worked.

Still another object of the invention is to provide metal powders suited for producing sintered compacts which can be rolled or forged, and a method of producing such metal powders.

Yet another object of the invention is to provide a method that makes it possible to practice powder metallurgy with metals of the type which would evaporate away during sintering in conventional methods, such as zinc, and alloys including such metals.

Figure 1:
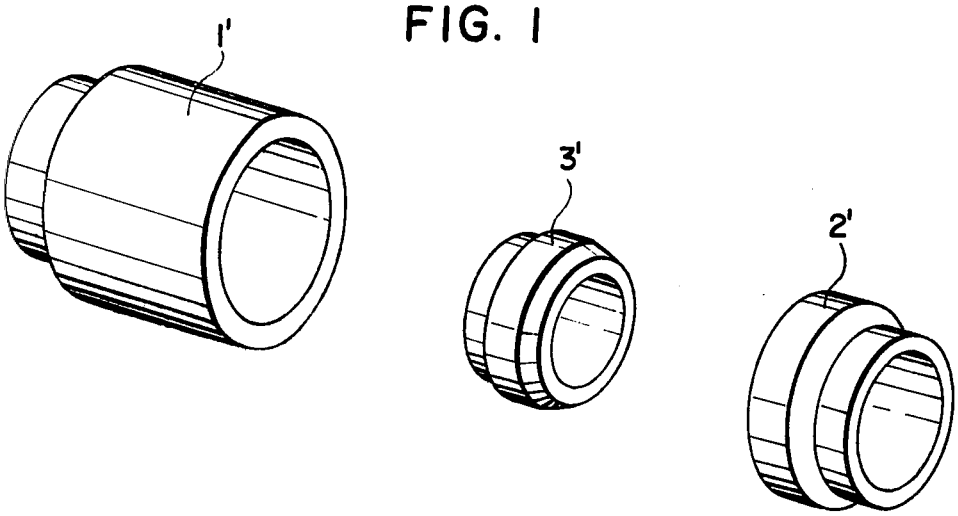
FIG. 1 is a perspective view showing the shapes of the respective green compacts used for making a valve casing.

In these drawings, reference numeral 1 indicates the valve casing, and 1' the green compact used to make the valve casing, 2 indicates the end cap and 2' the green compact for making the end cap, while 3 indicates the ball and 3' the green compact for making the ball.

H.R.B. shows a Rockwell hardness measured by a B scale.

DETAILED DESCRIPTION OF THE INVENTION

This invention relates to rolling and forging blanks obtained by using a powder metallurgy process and a specific process for producing such blanks.

The concept of producing a machine part by first forming a sintered compact having a shape close to that of the desired product and then subjecting said sintered compact to final working is well known in the art. It has, however, been considered impossible to produce with this process an article having as big a density as is obtained from molten metal because the sintered compact is porous and low in density.

The present inventors have undertaken extensive research and study with a view to obtaining a sintered compact that can be forged under pressure in order that a highly densified product might be obtained by first making a sintered compact having a shape close to that of the desired product and then subjecting such sintered compact to pressure forging. The present invention is the successful outcome of such efforts.

The present invention, more specifically, relates to a sintered compact which can be rolled or forged and a method of producing such a sintered compact characterized in that a compound of an alkali metal or alkaline earth metal is added to a metal powder suited for sintering and then the mixture is sintered.

The chemical action of a compound of an alkali or alkaline earth metal (hereinafter representatively referred to as alkali metal) used in the present invention is not yet definitely known, but it is considered that the following actions take place. The compound containing the alkali metal is decomposed by heating into a uniform solid solution in the form of the alkali metal alone or in the form of an oxide on the surfaces of the metal powder particles to be sintered. In this case, when such solid solution is cooled, a part thereof is again separated out in the form of the alkali metal, and it is considered that such separated alkali metal and the solid solution layer serve in combination to expedite sliding of the metal powder particles relative to each other when pressure is applied during compacting, so that a dense green compact may be obtained.

It is considered that the alkali metal separated on the metal powder surface is in the form of a solid solution at the bonded parts or necks of the metal particles and this promotes growth of the necks at a lower temperature to allow easy sintering. It is also considered that the crystal grain boundary of this solid solution layer portion slips easily under forging pressure, making it possible to practice rolling and forging.

The effect of the present invention is considered attributable to the above reasons, so that any metal which forms to some extent a solid solution with an alkali or alkaline earth metal can be employed to produce the sintered compact. However, better results are obtained when a heavy metal is used, particularly one which is hard to sinter, such as, for example, brass with high zinc content. A metal such as Si, Al, Sn or Mn, may be added to the brass, usually for the purpose of improving the properties of the product.

Any type of metal powder that has been used heretofore for sintering can be used. Since green compacting and sintering can be easily accomplished for the above reasons, it is possible, in accordance with the present invention, to use a metal powder having a particle size even greater than 50 mesh. The shape of usable powder particles also spans a wide range. Therefore, in the case of brass, cutting scraps or swarfs obtained from conventional castings can be used as originally produced or after only slightly crushing them.

As to the alkali metal compounds to be added to the metal powder, it is preferred to use the type of alkali metal compound which thermally decomposes to leave an alkali metal. For example, carbonates such as lithium carbonate, potassium carbonate or sodium carbonate are most practical and economical because they are inexpensive, but it is also possible to use other organic salts such as oxalates or acetates, or inorganic salts such as halides or silicofluorides as shown in Table 1 below.

Any amount of alkali metal compound may be added when such amount is just enough for the alkali metal to cover very thinly the surface of the metal powder for sintering at heat-treatment. Therefore, in a case such as brass, of course it differs depending on the particle size of the metal powders, alkali still remains after being sintered when too much alkali metal compound is used, and metal corrosion occurs. Consequently, the amount of additional alkali metal compound is preferably less than 0.1% to a metal powder. In the case of other metals, an amount of alkali metal compound can be added up to 1.0%. In this connection, the pH of the sintered compact when sintered by adding a brass to barium carbonate, is pH 7 when the amount of additional barium carbonate is 0.01 to 0.1%, and is pH 10 when it is 0.3%.

Table 1

Kinds of alkali metal compounds usable in the present invention and effects thereof

| Compounds added | | Kind of metal powder used | | |
|---|---|---|---|---|
| Kind of salts | Representative compounds | Cu-Zn | Cu-Ni-Zn | Fe-Ni |
| Carbonate | $K_2CO_3$ | * | * | * |
| | $Li_2CO_3$ | ** | ** | * |
| | $BaCO_3$ | * | * | ** |
| Oxalates | $K_2C_2O_4$ | * | * | * |
| | $Li_2C_2O_4$ | ** | ** | * |
| | $BaC_2O_4$ | * | * | ** |
| | $CaC_2O_4$ | * | * | * |
| Acetates | $CH_3COONa$ | * | * | * |
| | $CH_3COOK$ | * | * | * |
| | $CH_3COOLi$ | ** | ** | * |
| | $(CH_3CO_2)_2Ba$ | * | * | ** |
| | $(CH_3CO_2)_2Ca$ | ** | * | * |
| Chlorides | $KCl_2$ | * | * | * |
| | $BaCl_2$ | * | * | ** |
| Fluorides | NaF | * | * | * |
| | $CaF_2$ | * | * | * |
| | $BaF_2$ | * | ** | ** |
| Silicofluorides | $Na_2SiF_6$ | * | * | * |
| | $CaSiF_6$ | ** | * | * |
| | $BaSiF_6$ | * | * | * |
| Iodides | KI | * | * | * |
| | $CaI_2$ | * | * | * |

(Note)
Mark ** indicates excellent sinterability and forgeability, and mark * indicates good sinterability and forgeability.

The alkali metal compound may be added during sintering, but in most cases, it is added during the annealing treatment which is used to improve the compactibility of the metal powder. The annealing temperature and time may be suitably selected in dependence on the type of alkali metal compound used. The alkali metal compound may be introduced in the form of a powder or may be introduced after dissolving it in a suitable solvent, the latter being volatilized away after mixing. It suffices to add the alkali metal compound in such an amount that it will cover the surfaces of the metal powder particles. This amount varies according to the type and particle size of metal used, but in the case of brass, about 0.1% (by weight) of alkali metal compound is preferably used. (In the following discussion, all of the numerical values shown are based on the use of brass (40% Zn–60% Cu)).

The metal powder which has been heated and annealed together with the alkali metal compound as described above is treated with a lubricant according to a known method and then subjected to pressure molding at ambient or elevated temperature in a mold of a predetermined configuration. The green compact may be of a complicated configuration, which is characteristic of powder metallurgy, but it is preferred to select one by taking into account the plastic limit of the sintered compact, since it is next subjected to a forging process. It is also desirable to provide a well-calculated blank configuration to eliminate the extra work such as burring required in the conventional techniques. The green compact should preferably be molded to a density of more than about 6.5 g/cm$^3$.

The molded green compact is then heated and sintered in a reducing or neutral gaseous atmosphere conventionally used for sintering, such as, for example, an atmosphere of decomposed ammonia gas, nitrogen gas or endothermic gas at a temperature of around 750° to 850° C to obtain a sintered compact of a desired shape. It is desirable to carry out the above-said sintering in such a way that the resulting sintered compact will have a specific gravity greater than 7.5 g/cm$^3$ to make it possible to employ the forging step that follows sintering. For this purpose, the sintering temperature and time are suitably adjusted according to the density of the green compact.

The sintered compact is then subjected to a forging or rolling step. Forging or rolling of the sintered compact may be conducted immediately after completion of sintering, while maintaining the sintering temperature, or after cooling and storing for a certain period of time. Such forging or rolling is usually carried out by heating the compact to about 650° to 750° C, but in some cases, this step may be accomplished by warm or cold working.

For pressuring sintered blanks, a method is known in which the sintered blanks are squeezed into the forging dies from the outer wall, and also a method in which the sintered blanks are expanded outwardly from the inside. In the present invention, sintered blanks are produced which may be used in both the above methods, and also the pressure used for forging may be more than 20% lower than that required for forging of the material obtained by the conventional melting method. In the case of certain configurations, the heating temperature of the sintered compact may be lowered or the forging work may even be carried out at the ambient temperature.

A noticeable difference from the conventional forging techniques is that the sintered compact introduced into the forging mold contains a few air bubbles and hence, in some cases, deaeration is required during the forging step. Such deaeration may be accomplished in several ways, such as adjusting the speed of the forging pressure, applying a coating of graphite powder or the like as a deaerating agent to the sintered compact, or reducing pressure in the mold simultaneously with an increase in the externally applied pressure. Any of these methods can be used to suit the occasion.

According to the present invention, it is possible to make a sintered compact having a shape close to that of the desired product as blanks for rolling and forging can be obtained by using a powder metallurgy process. Therefore, no burrs are produced during forging and the resulting compact is in the shape of the desired completed product. Further, according to the present invention, it is possible to obtain products which can be easily rolled and forged and which have higher physical strength than conventional articles by adding an alkali metal compound.

In the foregoing discussion of the present invention, the process has been described as a method of making a rollable and forgeable sintered compact by adding a compound of an alkali or alkaline earth metal. We shall now discuss another effect of the present invention, which is to depress the vaporization or sublimation of metal during sintering.

Zinc is the metal which undergoes the most vigorous vaporization or sublimation during sintering, so that in the following discussion of the sublimation-depressing effect of the present invention reference is made to an example which uses a sintering powder of zinc-containing brass.

The sintering of brass involves many technical problems, most of which are ascribed to the high vapor pressure and the vigorous sublimation of zinc. Therefore, when sintering is carried out in the liquid-phase of two components supplied as a mixed powder of copper and zinc, by using the basic techniques of powder metallurgy, the resultant sintered body is poor in compactness, and much evaporation loss of zinc takes place during the heating-up, so that it is hardly possible to obtain a high-density sintered compact. Furthermore, such a mixed powder undergoes extensive thermal expansion in the course of the heating-up.

For these reasons, alloy powders have been developed and used for the sintering of brass, but since a heating treatment is indispensable for the manufacture of such alloy powders, it is possible to obtain brass powder with a high zinc content. Usually, a neutral or weak reducing gas is used for sintering, but as it is impossible to prevent an evaporation loss of the zinc component, the surface of the sintered compact is roughened by the dezincing phenomenom. Two methods are known for preventing such surface roughening: a method in which sintering is carried out in an atmosphere under a pressure higher than the vapor pressure of zinc, and a method in which sintering is carried out in a saturated vapor of zinc. The former method, however, is inefficient, because it cannot be carried out in a continuous heating furnace and must be carried out on a batch basis, while the latter method is uneconomical because the furnace body may be damaged by the zinc vapor. These factors have been an obstacle to the utilization of techniques of powder metallurgy in the sintering of brass type materials.

The present invention provides a sintering method in which the evaporation loss of zinc is minimized and also no specific atmosphere is required. It also envisages novel powder metallurgical techniques for the utilization of brass alloys (40% Zn–60%Cu) which have high mechanical strength and corrosion resistance, and the production of brass alloy powders used for the sintering of such alloys.

The sintering brass powder containing more than 35% zinc, which is the object of the present invention, cannot be obtained by the conventional spraying method or pulverizing method in which copper and zinc powders are mixed and sintered, because such methods include a sintering or melting step in which an excessive loss of zinc is caused by the sublimation of zinc, so that such methods are uneconomical and incapable of producing brass of the desired composition. Therefore, a method is employed in which brass containing a predetermined amount of zinc is cast and the casting is then cut and mechanically pulverized. For disintegration, the brass mass is first granulated to form brass particles of about 12 mesh in size and then these brass particles are further pulversized mechanically. Brass undergoes a change of hardness due to work-hardening in the first stage of pulverization and loses its malleability, so that it becomes easy to pulverize. Any known type of grinding machine such as a ball mill, rod mill, speed hammer mill, or atomizer can be used, and desired fines of less than 100 meshes can be obtained either by a dry process or by a wet process.

Since this pulverization step involves no heating, there is no evaporation loss of zinc and hence the powder is disintegrated without changing the original composition of the powder. The obtained fines are then heated to eliminate work strain as such work strain produced by work-hardening during pulverization still remains to affect compactness. According to the present invention, an alkali metal compound is then added to the fines, which are then heated at a temperature higher than that at which the added alkali metal compound is dissolved, to thereby eliminate work strain, and the resulting brass powder is further subjected to an alkali metal treatment to produce the desired brass powder having a high zinc content.

In the case of brass (30%Zn or 20%Zn) which has been commonly used for sintering, disintegration can be accomplished either by a spraying step or by a sintering-pulverizing step, and if the powder is subjected to an alkali metal compound treatment before compacting and sintering, it can be sintered with little evaporative loss of zinc.

The brass mass used for obtaining the powder used in carrying out the present invention may be formed by melting and casting the mixture of materials blended at a predetermined ratio for each sintering process, but it is also possible to use brass rods which are sold on the market.

The alkali metal compounds used in the present invention should be ones which are decomposed and vaporized upon being heated and which, when so vaporized, produce inactive gases which do not corrode brass, such as $SO_2$ or $NO_2$.

Although the action of the alkali metal compound is not known in detail, it is considered that a small amount of alkali metal is diffused and deposited on the surface of the brass powder by heating and, at the sintering temperature, such alkali metal prevents the oxidation of the powder owing to its reducing property and forms an azeotropic mixture with zinc to prevent evaporation loss of zinc at the sintering temperature, thereby expediting sintering.

The heating treatment is preferably effected by heating the mixture at a temperature higher than that at which the alkali metal compound is decomposed, until the decomposition gas ceases to be emitted, but it is also possible to carry out this heating treatment at the annealing temperature so as to concurrently anneal the metal. Usually, such treatment is carried out at a temperature of about 550° to 650° C.

As the alkali metal compound treatment is carried out at 550° to 650° C, the green compact of the brass powder according to the present invention undergoes no expansion with the change of state of zinc that takes place as it is heated up to 400° to 500° C, so that the bonds (necks) produced during compacting are stable and in a form permitting the easy progress of sintering. Also, since this powder has good flow and compression rates as well as excellent release characteristics when a lubricant is added, it can be easily compacted by an automatic compacting machine of the type generally used in powder metallurgy.

Thus, the products obtained according to the present invention are significantly low in manufacturing cost as compared with conventional products, and they also have excellent qualities and properties as disclosed in the following test examples embodying specific applications of the invention.

TEST EXAMPLE 1

Sintered compacts according to the present invention and those made by a conventional method were prepared, using various kinds of metal powders, and the densities of the respective green compacts, sintered compacts and sintered compacts after application of pressure were measured.

Each of the green compacts was formed by charging 10gr of powder into a die having 10 mm (diameter) under a pressure of $5 \times 10^3$ kg/cm$^2$. The resulting green compacts were heated in a nitrogen stream at a temperature suited to the respective metals therein for 30 minutes to obtain sintered compacts, and then each of these sintered compacts was charged into a die of the same diameter and subjected to a pressure of $7 \times 10^3$ kg/cm$^2$ at room temperature. Thereafter, the density of the resulting products was measured. The results are shown in Table 2. Each numerical figure in the table shows the mean value obtained from measuring 10 pieces of the material being tested.

As is apparent from the results in Table 2, the effect of the addition of an alkali metal is conspicious when using an alloy consisting of two or more kinds of metals.

In Table 2, the case of a brass containing 40% Zn is described as a representative example. Sintered compacts of brass powder which are practically used in conventional methods, are sintered compacts containing 30% Zn at the most. When such sintered compacts contain more than 30% Zn, the sublimation of Zn at sintering is too great and a sintered alloy for practical use cannot be obtained or sintering cannot be carried out. Accordingly, in the present invention, remarkable effects are shown when a brass containing more than 30% Zn is used.

Table 2

| Classification No. | Powder composition | Powder manufacturer (method) | Particle Size (mesh) | Admixture treatment | Sintering temp. and time | Density gr/cm$^3$ Green compact | Sintered compact | Repressing 7x $10^3$kg/cm$^2$ | Remarks |
|---|---|---|---|---|---|---|---|---|---|
| 1 | Cu 100% | G Co. U.S. (atomization) | −100 | $CaC_2C_4$ | 900° C 30 min. | 7.72 | 7.43 | 8.75 | |
| | | | | None | " | 7.71 | 7.25 | 8.60 | |
| 2 | Cu 70%-Zn 30% | N Co. U.S. (atomization) | −100 | $K_2C_2C_4$ | 800° C 30 min. | | | | |
| | | | | None | " | 7.30 | 7.25 | 8.05 | |
| 3 | Cu58.5%-Zn 40%-Pb 1.5% | Present Invention (pulverization) | −50 | $BaCO_3$ | 800° C 30 min. | 7.50 | 8.05 | 8.28 | |
| | | | | None | " | 7.50 | 7.00 | * | |

Table 2-continued

| Classification No. | Powder composition | Powder manufacturer (method) | Particle Size (mesh) | Admixture treatment | Sintering temp. and time | Density gr/cm³ Green compact | Sintered compact | Repressing 7x 10³kg/cm² | Remarks |
|---|---|---|---|---|---|---|---|---|---|
| 4 | Ni 100% | (carbonyl) | −325 | $K_2C_2O_4$ | 1000° C 30 min. | | | | |
| | | | | None | " | 6.75 | 7.50 | 8.20 | |
| | Cu 64%- | N Co. | | $Li_2CO_3$ | 900° C | | | | |
| Zn 16.5%- | | | | 30 min. | | | | | |
| 5 | | U.S. | −100 | | | | | | |
| | Ni 18% - | (atomization) | | None | " | 7.25 | 7.60 | 8.25 | |
| | Pb 1.5% | | | | | | | | |

Note:
Mark (*) indicate that no repressing was made because the sintered compact was of too low strength.

TEST EXAMPLE 2

Sintered compacts made according to the method of the present invention and those according to a conventional method were prepared using various types of metal powders, and these sintered compacts were subjected to hot forging at temperatures and under pressures suited to the respective types of metals to obtain disc-shaped forgings having an outer diameter of 45 mm and a thickness of 10 mm.

The variation in density and tensile strength of these forgings were measured, and the results are shown in Table 3. Each numerical figure in the table indicates the mean value obtained from 10 tested specimens.

Table 3

| Classification | Powder composition | Powder manufacturer (method) | Admixture treatment | Density of sintered compact gr.cm³ | Forgings Forging temp. | Forging pressure | Density gr/cm³ | Tensile strength kg/mm² | Remarks |
|---|---|---|---|---|---|---|---|---|---|
| 1 | Cu 100% | G Co. | $CaC_2O_4$ | 7.40 | 700° C | 3.5 | 8.89 | 25 | |
| | | U.S. (atomization) | none | 7.23 | 700° C | 3.5 | 8.70 | 21 | |
| 2 | Cu70%-Zn30% | N Co. | $K_2C_2O_4$ | 7.90 | 680° C | 4.0 | 8.50 | 38 | |
| | | U.S. (atomization) | none | 7.25 | — | — | — | — | |
| 3 | Cu58.5%-Zn40% -Pb1.5% | Present Invention (pulverization) | $BaCO_3$ | 8.05 | 650° C | 4.0 | 8.37 | 45 | |
| | | | none | 6.85 | — | — | — | — | |
| 4 | Ni 100% | (carbonyl) | $K_2C_2O_4$ | 7.60 | 750° C | 3.5 | 8.65 | 55 | |
| | | | none | 7.55 | 750° C | 3.5 | 8.70 | 62 | |
| 5 | Cu64%-Zn16.5% -Ni18%-Pb1.5% | N Co. | $Li_2CO_3$ | 7.85 | 680° C | 5.0 | 8.65 | 40 | |
| | | U.S. (atomization) | none | 7.55 | 680° C | 5.0 | 8.60 | 25 | |

A dash (—) shows that forging could not be made.

EXAMPLE 1

Cutting scraps of free cutting brass (JIS-H-3422) were degreased, magnetically screened to remove iron impurities, and then pulverized and passed through a 50-mesh sieve. 0.1% of anhydrous potassium carbonate was added to the resulting powder and then annealed in a nitrogen stream at 550° to 600° C to produce a powder having the properties shown in Table 4.

Table 4

| Item | Properties | |
|---|---|---|
| Chemical composition | Cu 58%, Pb 1.5%, Fe 0.3% Sn 0.2%, Zn remainder | |
| Particle size distribution | 50 – 100 mesh | 40% |
| | 100 – 150 mesh | 20% |
| | 150 – 200 mesh | 10% |

Table 4-continued

| Item | Properties | |
|---|---|---|
| | 200 – 250 mesh | 10% |
| | Greater than 250 mesh | 20% |
| Apparent density (bulk specific gravity) | 3.6 g/cm³ | |
| Fluidity | 29 sec/50 gr | |

0.2% of zinc stearate was then added to the above-said powder, subjected to a lubricant treatment in a mixing machine and then shaped by a compacting machine to obtain a green compact 1′ having a density of 7.5 g/cm³ and having a configuration as shown in FIG. 1.

Then this green compact was sintered in a decomposed-ammonia gaseous atmosphere (764 mmHg, flowing at the rate of 2l /min) at 800° C for 30 minutes to obtain a sintered compact. The resulting sintered compact, maintained at 650° C, was charged into a forging mold and forged under a pressure of 4 × 10³kg/cm² to produce a casing base material for a ball valve.

Figure 2:
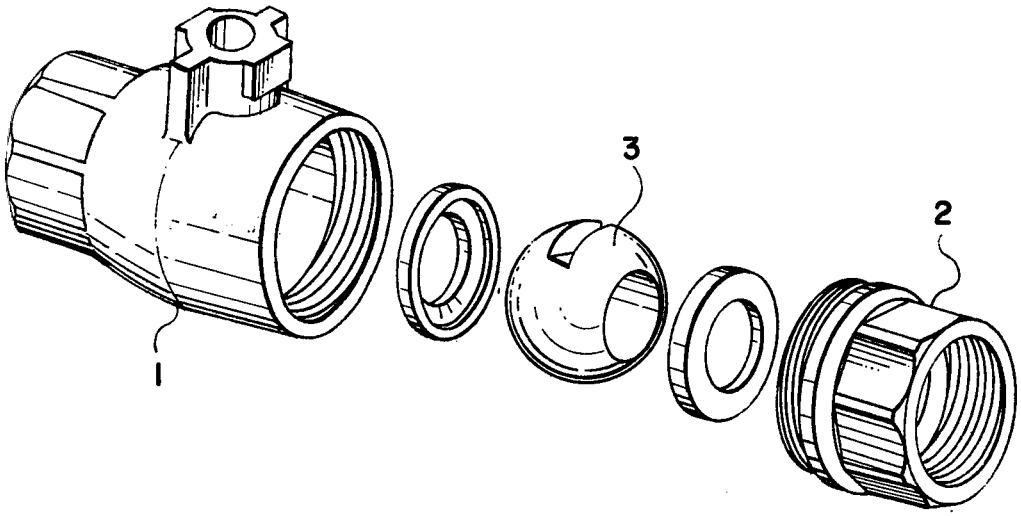
FIG. 2 is an exploded perspective view showing the respective parts of a completed ball valve.

Thereafter, the surface of the forging was cleaned by shot blasting or pickling and then subjected to machining, such as thread cutting, to obtain a ball valve casing 1 of the shape shown in FIG. 2. Practical tests were conducted on this ball valve casing, and yielding the results shown in Table 5. Each numerical figure in the table represents the mean value obtained from five specimens tested.

Table 5

| Test Item | Testing conditions | Results |
|---|---|---|
| Leakage test[1] | Air pressure 2 kg/cm² | No leak |
| | Air pressure 20 kg/cm² | No leak |
| | Air pressure 50 kg/cm² | No leak |
| Pressure test[2] | Water pressure 100 kg/cm² | No leak |
| | Water pressure 200 kg/cm² | No leak |
| Mercury test | JIS-H-3422 | No crack was observed (for 15 minutes) |
| Ammonia test | Under pressure of 20 kg/cm² for 90 hours | No crack was found |
| Endurance test | Left under pressure of 100 kg/cm² for 60 days | No abnormality |

Note [1]Compressed air of specified pressures was fed into the specimen valve and the valve was left in that state for one minute, and then air leakage from the specimen surface was examined.
Note [2]Water pressures (100 kg/cm² and 200 kg/cm²) were applied to a flat and regular hexagonal cap nut (measuring 32 mm on a side, and having a ¾" internal pipe thread with an end wall thickness of 2.60 mm) for one minute, and the end wall portion was examined for any breaks.

The results shown in Table 5 attest to the fact that the valve according to the present invention can well stand practical use as a multi-purpose high pressure valve.

The manufacturing cost of the valve casing according to the present invention, as compared with that required for manufacturing the same part according to conventional methods, can be reduced more than 30% owing to the raw material yield. Great improvements are also made in machining and manufacturing efficiencies to allow a marked cost reduction.

EXAMPLE 2

A valve ball 3 as shown in FIG. 2 was made by using the same powder as used in Example 1.

First, a thick cylindrical green compact 3' such as shown in FIG. 1 was formed after the manner of Example 1, and this green compact was sintered and then forged to obtain a spherical body closely akin to the desired ball, and then the forged spherical body was abraded to increase its spherical surface precision. Thereafter, a groove or recess for mounting the handle therein was formed by machining, thus obtaining the desired ball 3.

The resulting part was tested as in Example 1, and the test results showed that the product is quite serviceable as a general-purpose high pressure valve part.

Such a part has heretofore been made by cutting and abrading round bar stock without performing any plastic work, so that many man-hours were required, which caused an elevated cost. The manufacturing cost, however, can be markedly reduced by use of the blanks according to the present invention.

It is possible to make an end cap 2, such as shown in FIG. 2, in exactly the same way. In this case, a cylindrical green compact 2' having a stepped outer peripheral surface as shown in FIG. 1 is sintered and the sintered compact is forged into a shape similar to that of the end product, and then threads are cut by a tapping machine.

EXAMPLE 3

In this example an anticorrosive ball valve is made by utilizing multi-phase condition sintering of more than two different types of metal, which is characteristic of powder metallurgy.

To the free cut brass powder, which was used as a sintering powder in Example 1, 17% of pure nickel powder and then 0.1% of lithium oxalate were added and the mixture was annealed in a nitrogen stream at 550° to 600° C for about 30 minutes to obtain a powder having the properties shown in Table 6.

Table 6

| Item | Properties | |
|---|---|---|
| Chemical composition | Cu 48.3%, Ni 17.5%, Pb 1.25%, (Sn + Fe) 0.04%, Zn remainder | |
| Particle size distribution | 50 - 100 mesh | 0% |
| | 100 - 150 mesh | 17% |
| | 150 - 200 mesh | 20% |
| | 200 - 250 mesh | 25% |
| | 250 - mesh | 38% |
| Apparent density (bulk specific gravity) | 3.2 g/cm³ | |
| Fluidity | 45 sec/50 gr | |

This powder was further subjected to a lubricant treatment after the manner of Example 1 and a ball valve (consisting of a casing, an end cap and a ball) was made in the same way as Example 1 except for the 900° C and 30 minutes sintering conditions.

This valve was subjected to the same endurance test as Example 1 to obtain satisfactory results. It was also subjected to a 24 hour anticorrosion test and salt spray test together with nickel silver of JIS specification (JIS-H-3711) for comparison purposes, but not difference was observed.

EXAMPLE 4

Hard chrome plating (5$\mu$ thickness) was applied to the ball part of the ball valve obtained in Example 2, and this was put to an endurance test by subjecting it to salt spray and ammonia along with a similar chrome plated part manufactured by a conventional method. The results showed no difference between the product of the present invention and the conventional product.

Generally, most of the powder metallurgy products have pinholes piercing the surface, and such pinholes are not eliminated perfectly even by coining or forging, so that, usually, synthetic resin is infiltrated into the surface and then plating is applied thereover. The products of the present invention, owing to their excellent forgeability, are free of pinholes.

EXAMPLE 5

Cutting scraps of free brass (40%Zn - 60% CU) having the composition shown in Table 7 were degreased and then pulverized in a ball mill.

Table 7

| Elements | Cu | Pb | Fe | Sn | Zn |
|---|---|---|---|---|---|
| Composition (%) | 58.2 | 1.5 | 0.92 | 0.25 | remainder |

To this powder was added sufficient lithium carbonate powder to bring the lithium content of the powder to about 0.1%, and the powder was thoroughly mixed until homogeneous. Then the mixture was heated in a neutral atmosphere at a temperature of around 550° to 560° C, whereupon the lithium carbonate was decomposed, releasing carbon dioxide gas, and a small amount of lithium was diffused, infiltrated and settled on the surfaces of the brass powder particles. This phenomenon is considered to occur for the following reason. That is, although lithium carbonate is thermally decomposed at 550° C and divided into lithium oxide and carbon dioxide gas, it is considered that lithium oxide undergoes a certain chemical change in the presence of brass and is bonded thereto in a stable state.

The sintering brass powder of the present invention can be obtained in the above-described manner. If the lithium carbonate were added in the form of lithium oxide, the resulting powder would be highly hygroscopic and also exhibit strong alkalinity in the presence of water, because lithium oxide has such properties. On the contrary, the powder of the present invention showed no hygroscopic disposition even if left in the air for a long time. Also, even when the powder was thrown into water, the hydrogen ion concentration remained almost unchanged. Further, the work strain produced in the pulverizing step has been perfectly eliminated.

We will now discuss the green compactability of this brass powder and the properties of the sintered compact.

The powder was screened into groups of respective particle size ranges, and these were blended in the proportions shown in Table 8. A lubricant was added thereto and the powder mixed in a cone blender with a stirring speed of 20 r.p.m. at the rate of approximately 10 kg/hour to prepare a powder with fluidity of about 30 sec/50 gr, and this powder was then compacted in a predetermined mold to obtain a green compact.

Table 8

| Particle size (mesh) | Percent by Weight |
|---|---|
| 100 - 150 | 20 |
| 150 - 200 | 20 |
| 200 - 250 | 20 |
| 250 - 325 | 20 |
| 325 - | 20 |
| Apparent density of mixed powder | 3.4 g/cm$^3$ |

Figure 3:
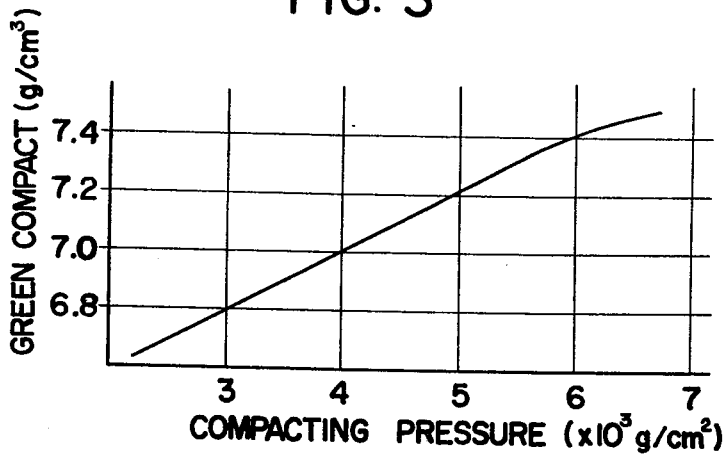
FIG. 3 is a diagram showing the relation between the density of a green compact and the compacting pressure exerted on the sintered powder according to the present invention.

FIG. 3 shows the relationship between the compacting pressure and density of the resulting green compact. The lubricant used in the compacting step is preferably metal salts of stearic acid, waxing powders or the like of a type generally used in powder metallurgy, Fe powder or Cu-Sn powder. The resulting green compact has good edge stability and has almost no tendency to spring back after compacting.

This green compact is heated and sintered in a stream of $N_2$ gas (flowing at the rate of about 3 l/min) at 800° C for 40 minutes to obtain a sintered compact. The lubricant separates at a temperature of 400° to 500° C in the course of heating, and thereafter almost no volatile material is produced and the particle necks grow. Substantially the same phenomenon as observed in the ordinary solid-phase sintering mechanism takes place until the temperature reaches the level of 500° to 700° C at which the intra-solid diffusion begins at the crystal grain boundaries, but as the temperature passes the level or vicinity of 700° C, the influence of the added alkali metal becomes conspicuous. That is, growth of the neck advances more and more rapidly and the spaces between the particles shrink and gradually diminish to increase density. The solid-phase sintering is completed at around 800° C. During this period, no change of composition takes place and also almost no evaporation loss of zinc is suffered. This is probably because the difference in osmotic pressure between the ions of the alkali metal added and the zinc in the brass composite causes an increase in the sublimation temperature of zinc to retard the dezincing which could otherwise be caused by evaporation loss.

Figure 4:
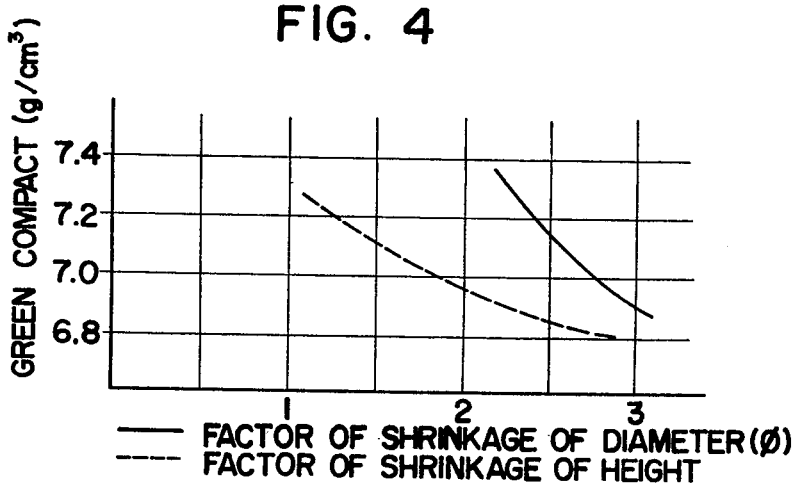
FIG. 4 is a diagram showing the change in diameter after sintering.
Figure 5:
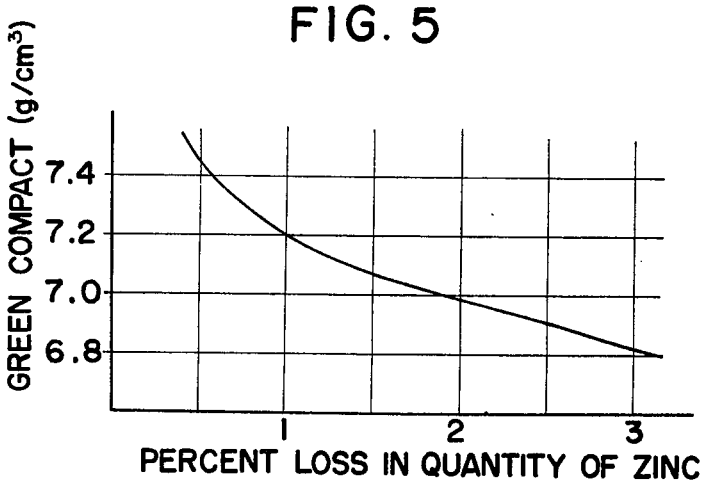
FIG. 5 is a diagram showing the loss in the quantity of zinc due to sintering.
Figure 6:
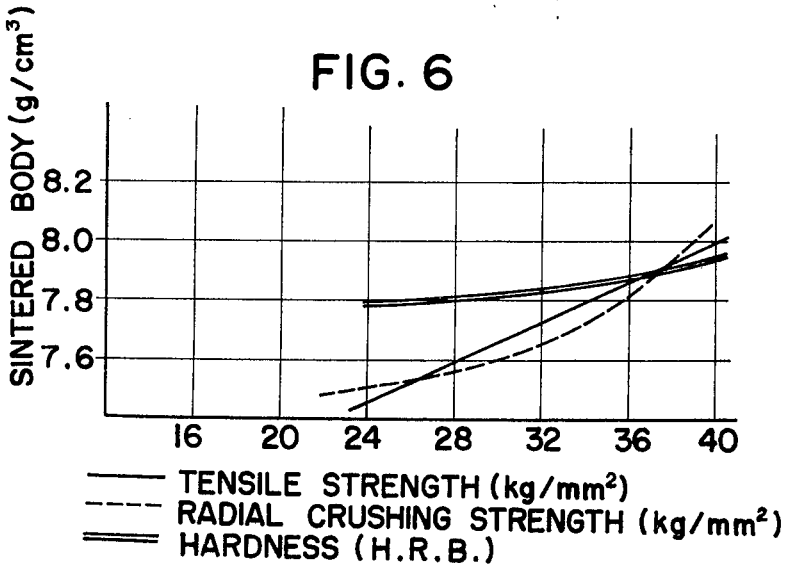
FIG. 6 is a diagram showing the mechanical properties of the sintered body according to the present invention.
Figure 7:
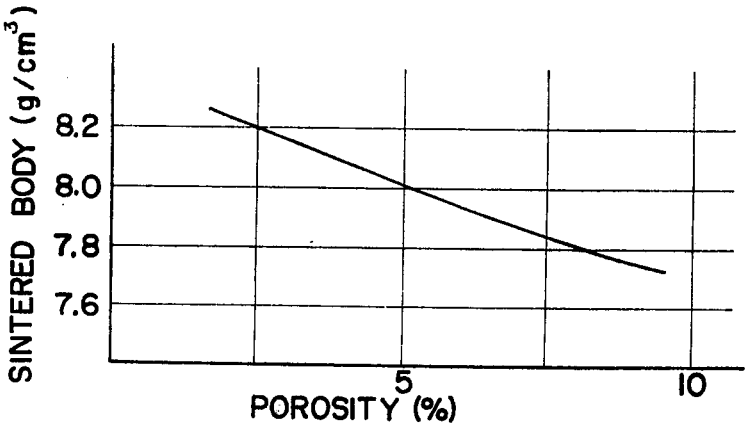
FIG. 7 is a diagram showing the relationship between the density and porosity of the sintered body.

Dimensional change (spring back) after sintering is shown in FIG. 4 by the relationship between the density and compression rate of the green compact. FIG. 5 shows the rate of loss in weight of zinc during sintering, and FIG. 6 shows the physical strength of the resulting sintered body. The relationship between the density and porosity of the sintered compact is shown in FIG. 7. As shown by the FIGS. 4 to 7, a gold-colored sintered compact can be obtained which has high physical strength and dimensional accuracy and which is beautifully lustrous on its surface.

When a brass powder (40% Zn - 60% Cu) which has not been treated with alkali metal as is the sintering powder according to the present invention is compacted and sintered in the same way as above, thermal expansion takes place at around 550° C. Its rate is 2 to 4% in the diametral direction and 5 to 8% in total length. Even if the temperature exceeds 700° C, no densification of the sintered compact takes place with growth of the necks and zinc is lost by evaporation. Also, no shrinkage of the sintered compact is caused at 800° C. This sintered compact is weak in mechanical strength, its tensile strength being less than 10 kg/cm$^2$. The loss of zinc by evaporation exceeds 8%.

Although the present invention has been described with respect to a power consisting of a copper-based alloy having a high zinc content (35 to 45%), it is of course possible to obtain the sintering powder from brass. Even when using conventional brass (20% Zn or 30% Zn), the loss of zinc by evaporation is only about 3 to 5%, and the density of the sintered compact is about 7.0 g/cm$^3$ at its highest.

The properties of the brass compacts according to the present invention are as shown in FIGS. 3 to 7. It will thus be appreciated that the present invention can be used as in economical brass working method as compared with the conventional forging-machining processes. The sintered compacts according to the present invention can be highly densified by warm forging to provide pressure-proof parts. Also, when an alkali metal is added to the base powder in the present invention, other metals such, for example, as Fe or Ni may also be added in a suitable amount to produce a friction material. Thus, the present invention provides not only powders for obtaining the zinc-rich brass sintered parts but also inexpensive matrices for use in powder metallurgy.

What is claimed is:

1. The method of making a sintered compact which comprises the steps of adding to the initial metal powder consisting principally of copper and zinc at least one compound containing an additive metal selected from the group consisting of alkali metals and alkaline earth metals, and thereby producing a mixture consisting essentially of said at least one compound, copper and zinc, annealing said mixture at a temperature higher than the decomposition temperature of said compound, and then compacting and sintering said mixture, said at least one compound being of a type which decomposes into at least one gas which has no corrosive effect on said initial metal power, together with at least one substance selected from the group consisting of said additive metals and their oxides which substance forms a coating on said initial metal powder during said annealing step which inhibits subsequent volatalization of said zinc during said sintering step.

2. The method of claim 1, wherein said compound is selected from the group consisting of carbonates, oxalates, acetates, halides and silicofluorides of said additive metals.

3. The method of claim 1, wherein the copper and zinc powder has a particle size of less than 50 mesh.

4. The method claimed in claim 1 in which said powder contains at least 35% zinc, and said compound is added in an amount such that the metal in said compound constitutes about 0.1% by weight of total metal.

5. The method claimed in claim 1 which comprises the further step of compacting and forging said sintered mixture.

6. The method claimed in claim 1 which comprises the further step of compacting and rolling said sintered mixture.

7. The method claimed in claim 1 in which said compound is selected from the group consisting of salts of said additive metals.

8. A sintered compact made by the method claimed in claim 1.

9. A sintered compact as claimed in claim 8 which has been forged to form a finished article.

* * * * *